US007540775B2

(12) United States Patent
Eckel et al.

(10) Patent No.: US 7,540,775 B2
(45) Date of Patent: Jun. 2, 2009

(54) ELECTRICAL PLUG AND METHOD OF FITTING THE PLUG

(75) Inventors: Markus Eckel, Bürstadt (DE); Rolf Hruby, Pforzheim (DE); Horst Neumeuer, Bad König (DE); Josef Woller, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 63 days.

(21) Appl. No.: 11/573,091

(22) PCT Filed: Jul. 22, 2005

(86) PCT No.: PCT/EP2005/008018

§ 371 (c)(1),
(2), (4) Date: Feb. 1, 2007

(87) PCT Pub. No.: WO2006/013027

PCT Pub. Date: Feb. 9, 2006

(65) Prior Publication Data

US 2007/0212936 A1 Sep. 13, 2007

(30) Foreign Application Priority Data

Aug. 3, 2004 (EP) ..... 04018381

(51) Int. Cl.
*H01R 13/40* (2006.01)

(52) U.S. Cl. ..... 439/587

(58) Field of Classification Search ..... 439/578, 439/579, 587–589, 608
See application file for complete search history.

(56) References Cited

U.S. PATENT DOCUMENTS

| | | | | |
|---|---|---|---|---|
| 3,904,812 | A * | 9/1975 | Daffron | 174/549 |
| 4,990,104 | A * | 2/1991 | Schieferly | 439/578 |
| 5,037,328 | A * | 8/1991 | Karlovich | 439/578 |
| 5,197,893 | A * | 3/1993 | Morlion et al. | 439/101 |
| 5,273,444 | A * | 12/1993 | Down et al. | 439/133 |
| 5,348,491 | A * | 9/1994 | Louwagie et al. | 439/188 |
| 6,109,963 | A | 8/2000 | Follinstad et al. | |
| 6,945,817 | B2 * | 9/2005 | Miyazaki et al. | 439/579 |
| 2003/0216072 | A1 | 11/2003 | Kato et al. | |
| 2004/0266260 | A1 | 12/2004 | Marechal et al. | |

FOREIGN PATENT DOCUMENTS

DE 20205430 U1 6/2002

* cited by examiner

*Primary Examiner*—Tulsidas C. Patel
*Assistant Examiner*—Larisa Tsukerman
(74) *Attorney, Agent, or Firm*—Barley Snyder LLC

(57) ABSTRACT

An electrical plug having a housing which surrounds a plug-in area, in which the plug may be connected with the plug receptacle, and a cable area, in which the cable may be connected to the plug, an insulator sleeve which surrounds a channel extending from the plug-in area to the cable area, into which channel an inner conductor element connected with the cable may be introduced from the cable area, a support sleeve which surrounds the insulator sleeve, connected with the insulator sleeve in the plug-in area and is connected with the housing in the cable area, a first cavity between the insulator sleeve and the support sleeve, into which an outer conductor element connected with the cable may be introduced, and a second cavity, which surrounds the support sleeve in the plug-in area, and into which a shield element of the plug receptacle may be introduced is disclosed.

23 Claims, 18 Drawing Sheets

B–B

C–C

D–D

ELECTRICAL PLUG AND METHOD OF FITTING THE PLUG

CROSS-REFERENCE TO RELATED APPLICATIONS

This application claims the benefit of the filing date under 35 U.S.C. § 119(a)-(d) of PCT Application No. PCT/EP2005/008018 filed Jul. 22, 2005 which claims priority to foreign patent application DE 04018381.6 filed Aug. 3, 2006.

FIELD OF THE INVENTION

The present invention relates to an electrical plug, a cable provided for fitting to the plug and a method for fitting the plug on a cable.

BACKGROUND

For the purposes of the present patent application, an electrical plug and an electrical plug receptacle are electrical components which are intended on the one hand to be firmly or permanently connected to a cable and on the other hand to form a preferably detachable plug-and-socket connection with a mating component. Here, the mating component of the plug is designated plug receptacle and the mating component of the plug receptacle is designated plug. The plug is preferably a separate component, which serves solely to connect the cable with a plug receptacle. The plug receptacle may, on the other hand, also be incorporated into a housing of any desired apparatus. This may alternatively also be the case for the plug.

In engineering and in particular in electrical engineering, a large number of plugs and plug receptacles of many different types are known. These serve to transmit electrical power and/or electrical signals with the widest possible range of voltages, currents, frequencies and data rates. Furthermore, plug and plug receptacle fulfill other functions. For damp, dusty or chemically aggressive environments, plugs and plug receptacles comprise sealing elements which prevent penetration of the surrounding media into the plug and plug receptacle and corrosion thereof or the formation of conductive deposits therein. Securing elements such as screw threads or latches ensure a secure plug-and-socket connection, even if the plug-and-socket connection is exposed to mechanical tension or vibrations.

Due to the extremely wide range of applications and conditions of use, a wide variety of optimized plugs and plug receptacles are to be found.

A relatively new field of use for plugs and plug receptacles is the transmission of drive power in an electrically driven motor vehicle. This drive power has to be transmitted between an energy storage means, for example a storage battery or a fuel cell, and a power converter, for example a four-quadrant converter, and between the latter and the drive motor(s) in one direction or in both directions alternately. Between the energy storage means and the power converter, the electrical power is transmitted substantially in the form of d.c. voltage and a direct current. Between the power converter and the drive motors, the electrical power is transmitted for example in the form of a three-phase current. Conversion in the power converter may occur by means of pulse width modulation. The a.c. voltage and alternating current component, in particular on transmission of the power between the power converter and motors, may lead to the emission of electromagnetic interference signals, which may disturb other electrical and electronic systems inside and outside the vehicle. The emission of interference signals is prevented by providing the lines via which the electrical power is transmitted with shielding. This ensures electromagnetic compatibility (EMC) and minimizes the risk of harm to the health of individuals in the surrounding area.

Motor vehicles with an electromotive drive existed until recently only in the form of prototypes or short run models. For this reason, the plugs and plug receptacles which have been used in the power transmission area are those which are readily available but are distinguished for the most part by a robust but also very complex structure. These plugs and plug receptacles are therefore complex and expensive to produce and fit.

With electrically driven motor vehicles moving into the realms of series and mass production, the demands placed on the plugs and plug receptacles in the power transmission area are also changing. They not only have to be robust and ensure long-term, malfunction-free functioning over the entire life of the motor vehicle but also have to be simple and cheap to produce and fit.

SUMMARY

The present invention relates to an electrical plug for a cable having an inner conductor, an outer conductor, and insulation between the inner conductor and the outer conductor, for transmitting electrical drive power for a motor vehicle between the cable and a plug receptacle, the electrical plug having a housing which surrounds a plug-in area, in which the plug may be connected with the plug receptacle, and a cable area, in which the cable may be connected to the plug, an insulator sleeve constructed of an electrically insulating material, which surrounds, in the manner of a jacket, a channel extending from the plug-in area to the cable area, into which channel an inner conductor element connected with the cable may be introduced from the cable area, a support sleeve, which surrounds the insulator sleeve in the manner of a jacket, connected mechanically with the insulator sleeve in the plug-in area and is connected mechanically with the housing in the cable area, a first cavity between the insulator sleeve and the support sleeve, into which an outer conductor element connected with the cable may be introduced, and a second cavity, which surrounds the support sleeve in the plug-in area, and into which a shield element of the plug receptacle may be introduced.

An object of the present invention therefore consists in providing an electrical plug, an electrical plug arrangement, a cable intended for fitting to a plug and a method of fitting a plug on a cable which make it possible to produce the plug and fit it to a cable more simply and cheaply.

The present invention is based on the following idea: when fitting a plug to a cable with an inner conductor and an outer conductor, first of all an inner conductor element of the plug is connected to the inner conductor of the cable and an outer conductor element of the plug is connected to the outer conductor of the cable and only then is an insulator sleeve for electrical insulation of the inner conductor element from the outer conductor element introduced therebetween. The insulator sleeve may be connected firmly to the plug, in particular is constructed integral with the housing thereof, wherein introduction of the insulator sleeve takes place at the same time as insertion of the inner conductor element connected to the inner conductor and of the outer conductor element connected to the outer conductor into the housing of the plug. Alternatively, the inner conductor element connected to the inner conductor of the cable and the outer conductor element connected to the outer conductor of the cable are inserted into the housing of the plug before the insulator sleeve is introduced between the inner conductor element and the outer conductor element.

To enable such fitting of the plug and the cable, the electrical plug comprises an insulator sleeve and a support sleeve, which are arranged inside one another and are connected together at a front end of the plug with respect to the plug-in direction. The support sleeve is connected to the housing of the plug in an area set back in the plug-in direction. Thus, the plug comprises a continuous channel surrounded by the insulator sleeve in the manner of a jacket, into which channel an inner conductor element connected to the cable may be inserted into the plug from the rear end thereof in the plug-in direction, which element is then accessible from a front end in the plug-in direction for electrical contacting by a plug receptacle. Between the insulator sleeve and the support sleeve there is located a first, approximately jacket-like cavity, which is open towards the rear end of the plug with respect to the plug-in direction, such that an outer conductor element connected to the cable may be introduced from there into said first cavity. The support sleeve is surrounded by a second cavity, which is open towards the front end of the plug with respect to the plug-in direction. When the plug is connected to the plug receptacle, said second cavity accommodates a shield element of the plug receptacle.

A shield is arranged in the second cavity, which advantageously substantially completely surrounds the support sleeve. A plurality of first contact elements are provided on the shield or on the shield element for the purpose of projecting openings in the support sleeve and providing an electrically conductive connection between the shield and the shield element. One or more second contact elements are provided on the shield for the purpose of contacting the shield element of the plug receptacle when the plug is connected to the plug receptacle.

Alternatively, the plug does not comprise any shield, but rather merely comprises one or more openings in the support sleeve. One or more contact elements attached to the outer conductor element, in particular constructed integral therewith, pass through these openings in order to contact the shield element of the plug receptacle when the plug is connected to the plug receptacle.

The present invention is additionally based on the idea of providing a plurality of shield elements in the case of an electrical plug for a plurality of cables each with an inner conductor and an outer conductor, wherein each shield element separately produces an electrically conductive connection between the shield of in each case one of the cables and one of a plurality of shield elements of a plug receptacle, when the plug is connected with the plug receptacle. The above-described structure of a plug according to the invention is particularly suitable for such a plug with a plurality of separate shield elements for a corresponding plurality of shielded cables.

The present invention is further based on the idea of providing, in the case of an electrical plug for a plurality of cables, a cover consisting of two or a corresponding plurality of cover members, which are intended in each case to grip a round one of the cables and retain a seal for sealing gaps between the cable and a plug housing. These cover members may be held together by retaining means, for example cover webs and cover grooves engaging in one another. It is particularly advantageous for the cover members to exhibit the same shape and be arranged symmetrically with one another on the plug. The symmetry operation involved here is for example rotation through 180° or displacement by the spacing between two neighboring cables.

An advantage of the present invention is that it considerably simplifies and reduces the price of construction and fitting of the plug and at the same time provides the plug with excellent mechanical and electrical properties. The housing is advantageously of integral construction with the support sleeve and the insulator sleeve. Fitting is greatly simplified in that first of all an inner conductor element is connected with the inner conductor of the cable and an outer conductor element with the outer conductor of the cable, for example by crimp connections. The cable prepared in this way is then simply introduced into the plug, where a latch connection holds it in place.

Production of a plug according to the invention is additionally simplified in that the cover, which retains the seals between the cable and the housing, consists of two or more cover members, which are held together by retaining means. This modular construction of the cover reduces production costs, since two identical cover members may be used for one plug. In addition, if the individual cover members are constructed appropriately, the same cover members may be used with plugs for different numbers of cables.

A plug according to the invention additionally comprises a securing element, which locks the inner conductor element with the plug. This securing element is so constructed that it can only adopt its intended position when the inner conductor element is held together with the plug as intended by a latch connection.

In addition, the securing element may assume a coding function, in that a different configuration solely of the securing element allows the plug to be conformed to a selected one of a plurality of different plug receptacles. This option is particularly advantageous if it is to be ensured that plug-and-socket connections are not mixed up. This is the case, for example, when an identical plug is to be used at a number of points in a motor vehicle due to similar electrical and mechanical requirements but each plug should match only one of a number of plug receptacles. The plug receptacles are differently configured, and each plug is conformed to one of the plug receptacles by selecting one of several different securing elements. Since, apart from the securing element, the other components are identical for all the plugs, these components may be produced in large numbers and thus economically. In particular, mold conversion kits for the various coding configurations have to be introduced only into the smaller, relatively simple mold for producing the securing element.

In addition to use for electrical transmission of drive power in vehicles, the present invention is also suitable for other applications in motor vehicles or in other fields of use.

BRIEF DESCRIPTION OF THE DRAWINGS

Preferred exemplary embodiments of the present invention are explained in more detail below with reference to the attached Figures, in which.

DETAILED DESCRIPTION OF THE EMBODIMENT(S)

Figure 1:
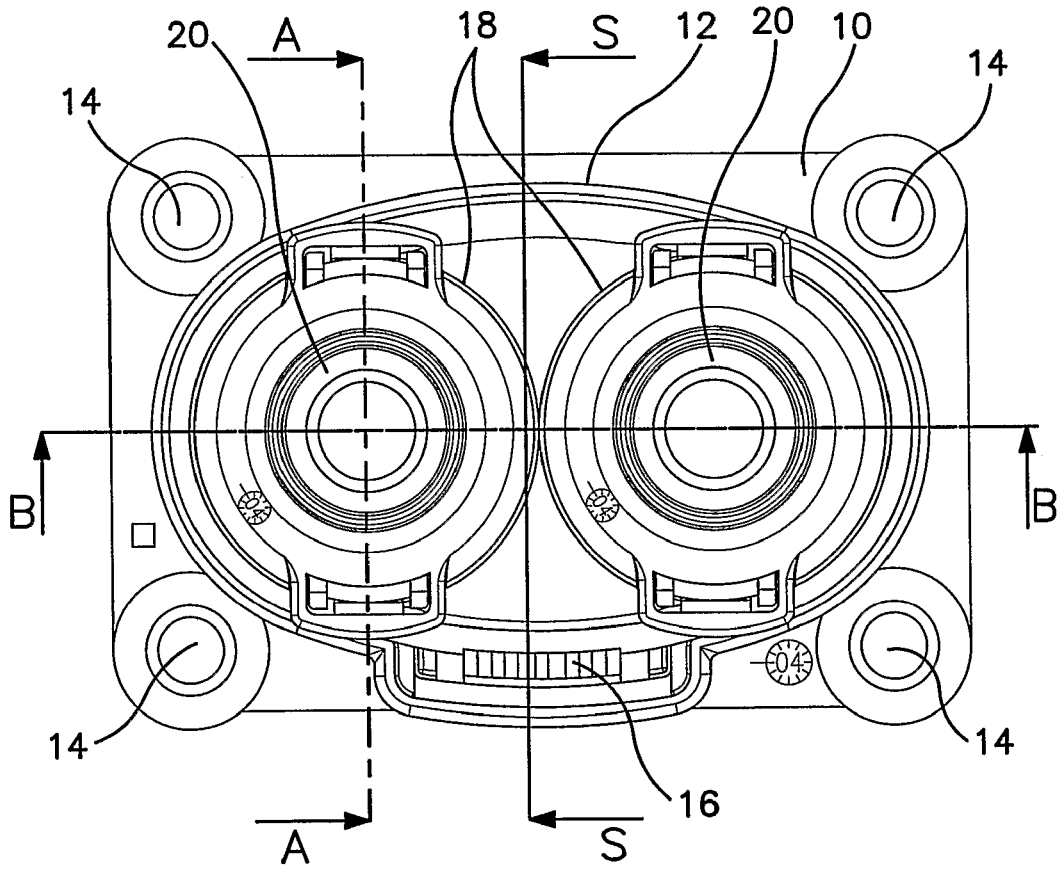
FIG. 1 is an orthogonal view of a plug and a plug receptacle according to an embodiment of the present invention.

FIG. 1 shows an orthographic view of a plug receptacle 10 and a plug 12, according to an exemplary embodiment of the present invention, wherein the viewing direction corresponds to the plug-in direction and the direction in which cables are introduced into the plug 12. This view shows that the plug receptacle 10 substantially exhibits the form of a rectangle, at each of the four corners of which there is provided a through-hole 14. By means of the through-holes 14, the plug receptacle 10 may be attached for example to a housing of a power converter or an energy storage means, such as a battery or a fuel cell.

Still referring to FIG. 1, plug 12 exhibits an external contour which is substantially oval. In particular, the contour is composed of four circular arc portions, of which in each case two opposing ones exhibit identical radii, or of two circular arc portions and two straight lines. Alternatively, the contour substantially exhibits the form of an ellipse. On one side, the contour of the plug connector 12 is widened. At this point, the plug 12 comprises a latching spring 100 for connection with a latch member 16 of the plug receptacle 10. This connection is explained in more detail below with reference to FIG. 7.

Still referring to FIG. 1, caps 18 are additionally visible, the function of which is explained in more detail below with reference to FIGS. 4 and 5. Concentric to each of the caps 18 is the cross section of a cable 20 fitted to the plug 12.

Figure 2:
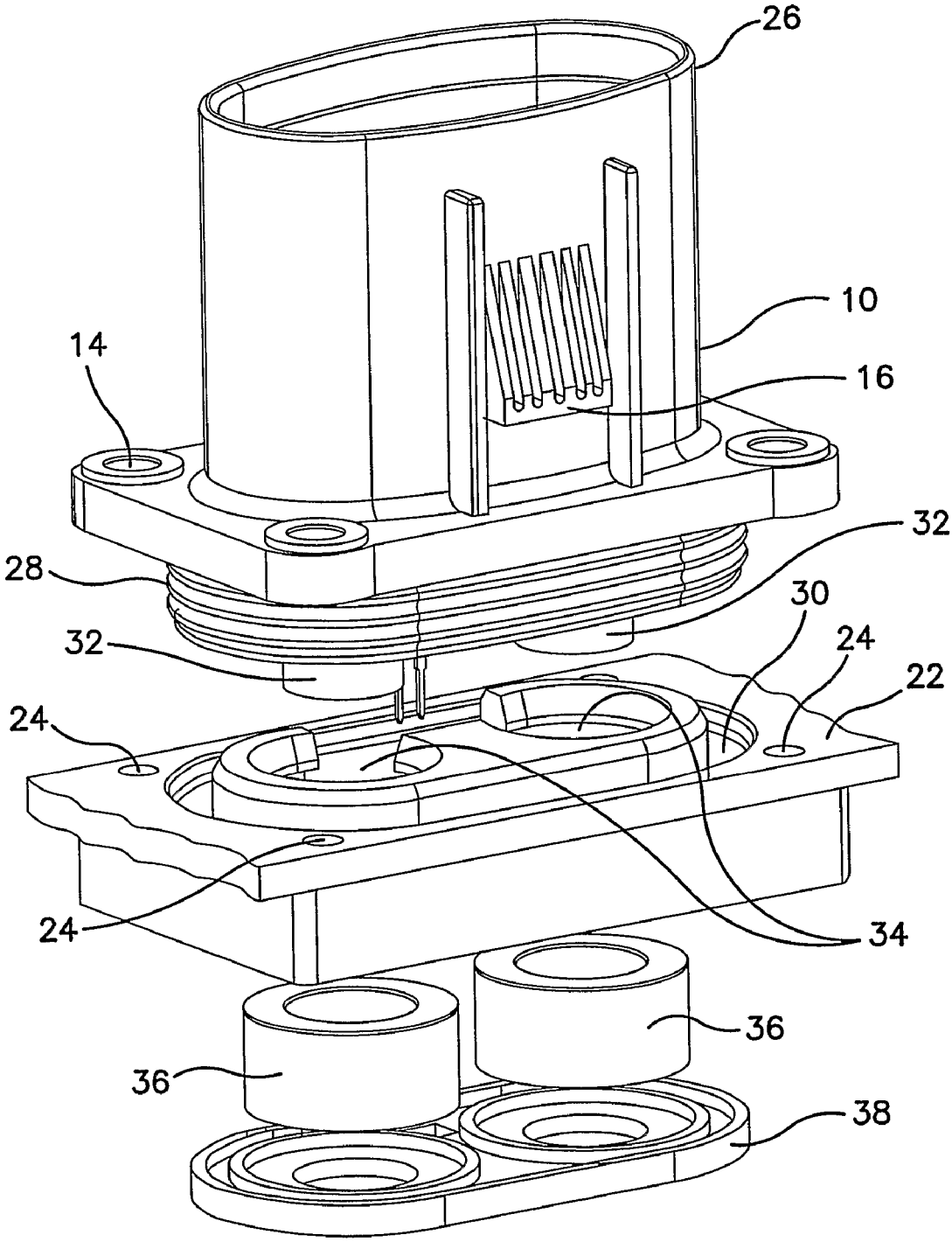
FIG. 2 is an oblique exploded view of the plug receptacle of FIG. 1.

FIG. 2 shows the plug receptacle 10 fitted to a plate 22. The plate 22 may take the form of a separate component or be of integral construction with a housing of an electrical apparatus. It comprises openings 24, which may be provided with an internal thread. The plug receptacle 10 is fitted on the plate 22 by passing a screw through each of the through-holes 14 and into the openings 24.

The plug receptacle 10 consists substantially of a rectangular plate, which is of integral construction with a first collar 26 on its top and a second collar on its bottom.

The first collar 26 is identical in shape to the cross section of the plug 12 illustrated in FIG. 1. The latch member 16 is attached to an outside of the first collar 26. The second collar is concealed in the illustration in FIG. 2 by a seal 28, which completely surrounds the second collar. The plate 22 comprises a groove 30, in which the second collar and the seal 28 engage when the plug receptacle 10 is fitted to the plate 22.

The plug receptacle 10 is additionally of integral construction with two tubular sleeves 32, which project beyond the second collar toward the plate 22. The plate 22 comprises two sleeve-receiving openings 34, in which the sleeves 32 of the plug receptacle 10 engage when the plug receptacle 10 is fitted to the plate 22. Two ferrite members 36 are provided for surrounding the sleeves 32 extending through the sleeve-receiving openings 34 in the plate 22. An insulating plate 38 holds the ferrite members 36 in place on the plate 22 when fitted together.

Figure 3:
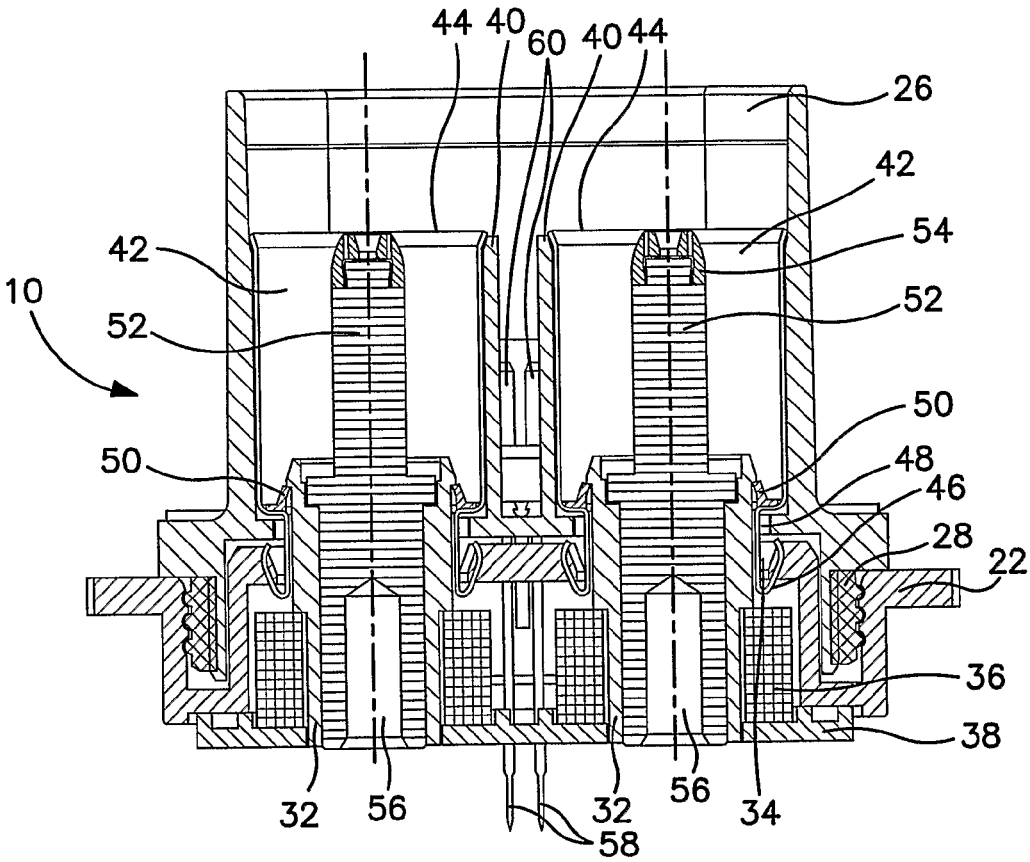
FIG. 3 is an orthogonal cross-sectional view of the plug receptacle of FIG. 1.

FIG. 3 shows that inside the first collar 26 there is formed the plug receptacle 10 in the form of two circular-cylindrical guide members 40, in which are arranged shield elements 42. Each shield element 42 may be formed from sheet metal and likewise exhibits in its upper portion a circular-cylindrical shape, which rests against a wall of the corresponding guide member 40 of the plug receptacle 10. An upper edge 44 of each of the shield elements 42 is flanged slightly outwards. At a lower portion, each of the shield elements 42 comprises a number of contact springs 46, which are arranged around its lower circumference. Each of the contact springs 46 projects through an aperture 48 towards the bottom of the plug receptacle 10 into the sleeve-receiving opening 34 in the plate 22 and rests against an edge thereof. In the case of an electrically conductive plate 22, the contact springs 46 transmit the shield potential thereto. Each of the shield elements 42 is held in the above-described position by a retaining ring 50. Each of the retaining rings 50 surrounds an upper end of the sleeves 32 formed integrally with the insulating plate 38 and the first collar 26. The sleeves 32 comprise a circumferential latch edge, with which the retaining ring 50 is held together by a latching connection.

A contact pin 52, which consists of a conductive material, in particular of metal, is arranged concentrically with each of the shield elements 42. Insulating caps 54 are attached to upper ends of the contact pins 52. The radial distance between the contact pin 52 and the shield element 42 is less than a diameter of a human finger. The insulating caps 54 thus provide shock hazard protection for the contact pins 52 and thus finger-touch safety for the plug receptacle 10, as is prescribed in many fields by law or standards. A lower end of each of the contact pins 52 is arranged in one of the sleeves 32 and is secured there for example by form-fit, a latching connection or adhesive bonding. Each of the contact pins 52 further comprises at the lower end a bore 56, by means of which an electrical line may be attached to the contact pin 52.

Lower ends of two signal contacts 58 project through the insulating plate 38 for connection to signal leads. Upper ends 60 of the signal contacts 58 are arranged between the guide members 40 and an internal wall of the first collar 26. The plug 12, explained in more detail with reference to later Figures, short-circuits the upper ends 60 of the signal contacts 58 when it is connected with the plug receptacle 10. The arrangement of the signal contacts 58 and in particular the upper ends 60 thereof ensures that, when the plug 12 is separated from the plug receptacle 10 that the short-circuit between the signal contacts 58 is cancelled and before contact is broken between the plug receptacle 10 and the contact pins 52 and the shield elements 42.

The signal contacts 58 are connected with an apparatus, not shown, which controls the transmission of electrical power via the plug receptacle 10 and the plug 12, for example using the above-mentioned power converter in a motor vehicle.

This apparatus is so designed that voltage is applied to the contact pins 52 and/or current flows therethrough only when the signal contacts 58 are short-circuited, i.e. the plug receptacle 10 is connected with a plug 12, so ensuring that no voltages are applied to the plug receptacle 10 or the contact pins 52 when the plug receptacle 10 is not connected with a plug 12. It is additionally ensured that a circuit in which the plug receptacle 10 is located is not broken by separation of the plug 12 from the plug receptacle 10 but rather is broken beforehand. Arcing at the contact pins 52 and the resultant wear thereto is thus prevented. This function is also known as an interlock function.

Figure 4:
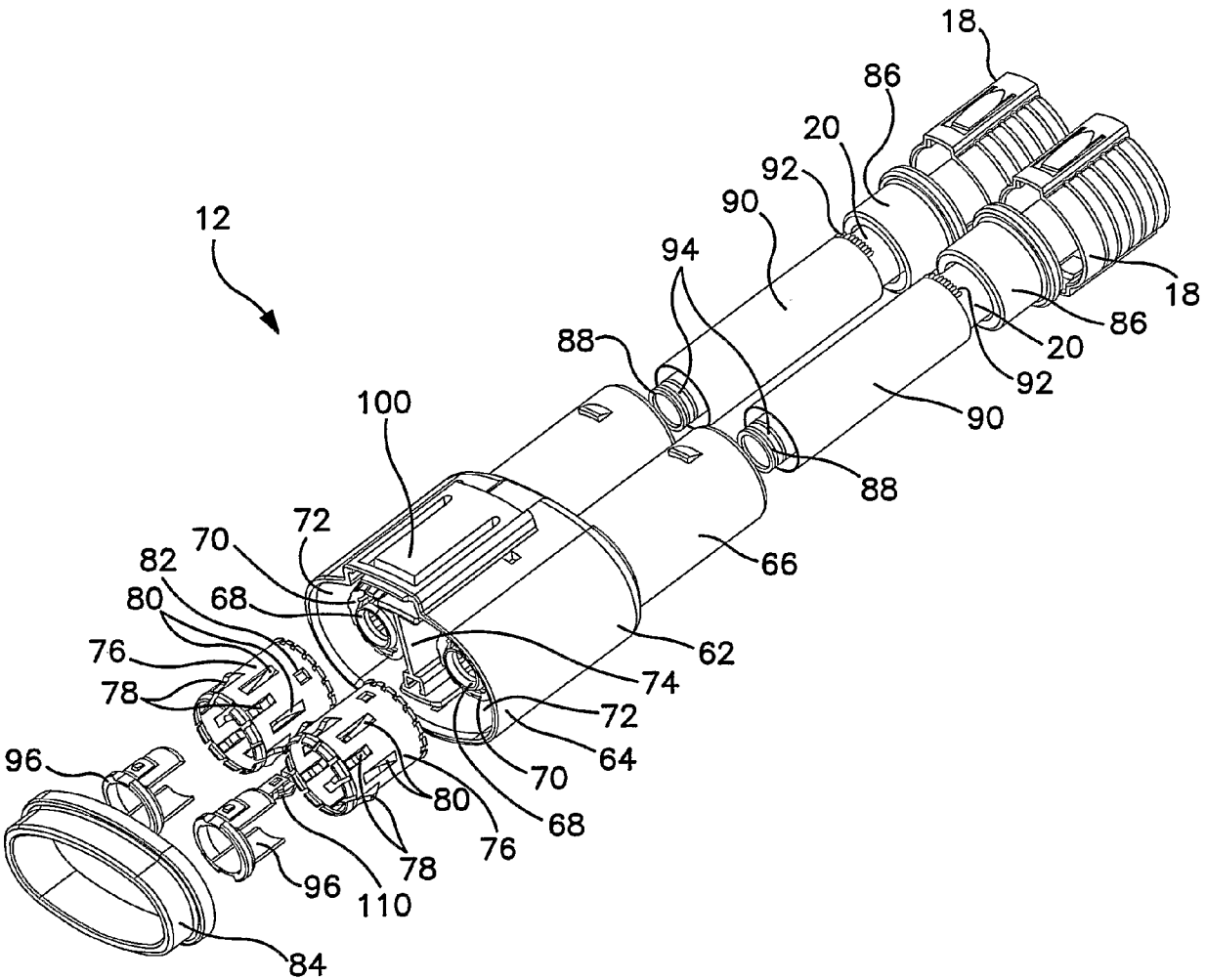
FIG. 4 is an oblique exploded view of the plug of FIG. 1.

FIG. 4 shows that the plug 12 comprises a housing 62, which exhibits the oval cross-section described in relation to FIG. 1 in a plug-in area 64 arranged at a front with respect to a plug-in direction. In a cable area 66 arranged to a rear with respect to the plug-in direction, the housing 62 comprises two tubes arranged in parallel. On one side of the housing 62 there is provided a latch spring 100 in the plug-in area 64, which latching spring 100 is provided for latching connection with the latch member 16 on the plug receptacle 10.

Inside the housing 62 there are arranged two insulator sleeves 68 and two support sleeves 70. One of the insulator sleeves 68 and one of the support sleeves 70 are in each case arranged coaxially to one another and connected to one another at a front end visible in FIG. 4, such that in each case a first jacket-like cavity arises between the insulator sleeve 68 and the support sleeve 70. The support sleeves 70 are surrounded in the plug-in area 64 by a second cavity 72. A web 74 is arranged in the second cavity 72 between the support sleeves 70.

A shield 76 is introduced into each of the second cavities 72. Each of the shields 76 consists of a substantially tubular sheet metal element with first spring contacts 78 distributed evenly around its circumference in the vicinity of its front edge, these being provided to contact the shield elements 42 of the plug receptacle 10 when the plug 12 is connected with the plug receptacle 10. Each shield 76 additionally comprises a plurality of inwardly directed second spring contacts 80 distributed evenly over its circumference, the function of which is described further below. Spring members 82 on the shields 76 are provided for holding the latter in place in relation to the support sleeves 70.

A plug seal 84 is provided for insertion into the second cavity 72 in front of the shields 76 and to protect the inside of the plug 12 and the plug receptacle 10 from environmental influences when the plug 12 and the plug receptacle 10 are connected together.

Two shielded cables 20 are provided for insertion into the plug 12. A cable seal 86 and a cap 18 are drawn over each of the cables 20. An inner conductor element 88 is crimped or otherwise connected to an inner conductor of each of the cables 20. Each of the inner conductor elements 88 has an opening at its front end, which is provided to accommodate and electrically conductively contact the contact pin 52 of the plug receptacle 10 when the plug 12 is connected to the plug receptacle 10. An outer conductor element 90 is crimped or otherwise connected to an exposed outer conductor 92 of each of the cables 20. In the case of crimping, the exposed outer conductor 92 may be pulled back over an internal crimping sleeve, such that it is squeezed after crimping between the internal crimping sleeve and the outer conductor element 90.

The inner conductor elements 88 and the outer conductor elements 90 are arranged coaxially to one another. When they are introduced into the housing 62, the insulator sleeve 68 comes to lie in the jacket-like cavity between the inner conductor element 88 and the outer conductor element 90. The insulator sleeve 68 may overlap with the insulation arranged between the inner conductor and the exposed outer conductor 92 of the cable 20.

At the front end, each of the inner conductor elements 88 comprises a groove 94 in its outer circumference, in which a locking member 108 (see FIG. 6) engages when the inner conductor element 88 has been fully introduced into the housing 62 of the plug 12. This connection between the inner conductor element 88 and the housing 62 of the plug 12 is locked together in each case by a securing element 96. The securing elements 96 catch in turn in the plug 12.

Figure 5:
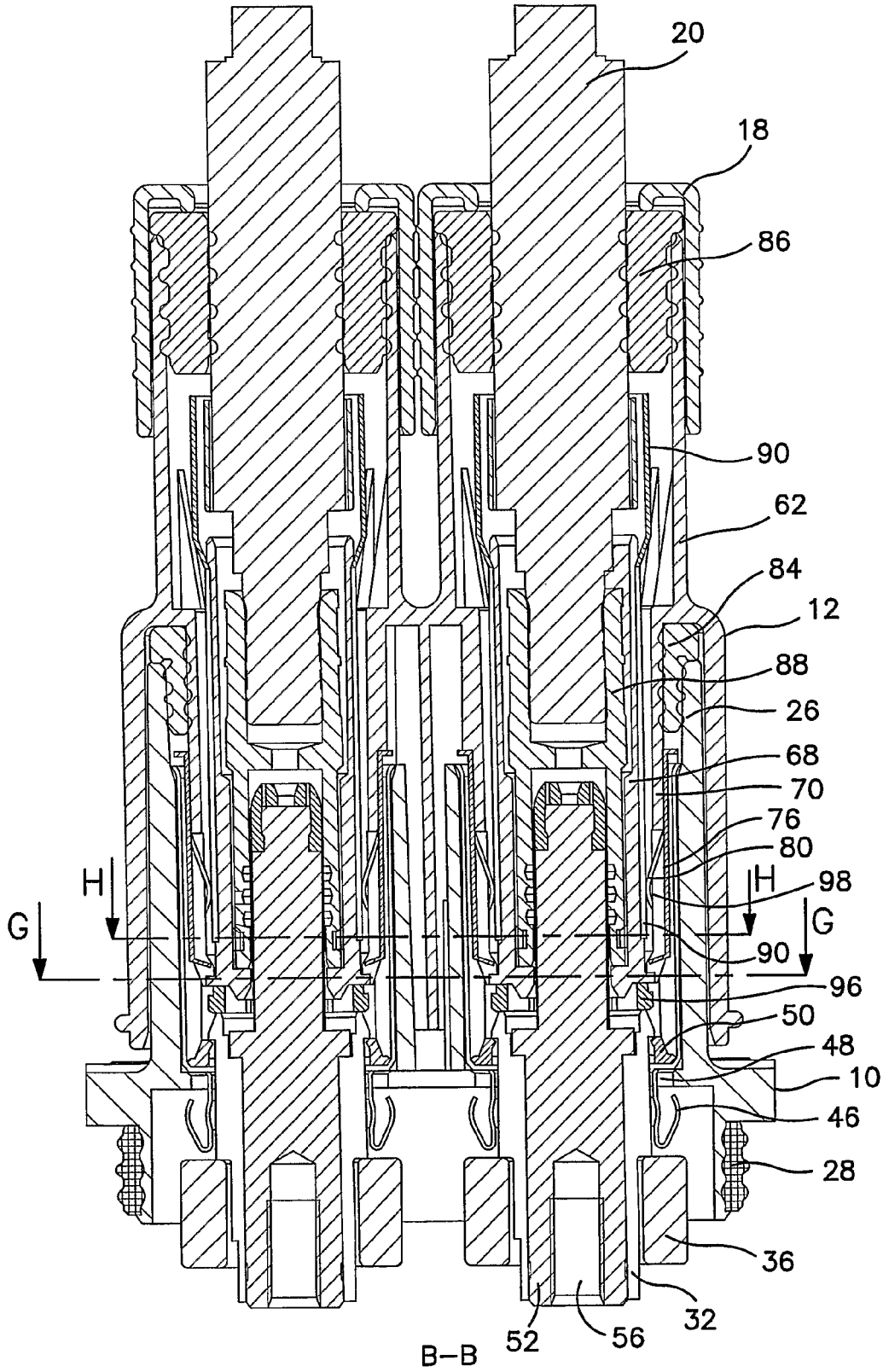
FIG. 5 is an orthogonal cross-sectional view taken at cutting line B-B of FIG. 1 of the plug of FIG. 1.

FIG. 5 makes it particularly clear how the insulator sleeve 68 is arranged between the inner conductor element 88 and the outer conductor element 90. It can also be seen how the support sleeve 70 is arranged between the outer conductor element 90 and the shield 76. The second spring contacts 80 project through openings 98 in the support sleeve 70 and contact the outer conductor element 90. When fitted-together, the cable seals 86 are held by the caps 18 in the cable area 66 in spaces between the housing 62 and the cables 20.

Figure 6:
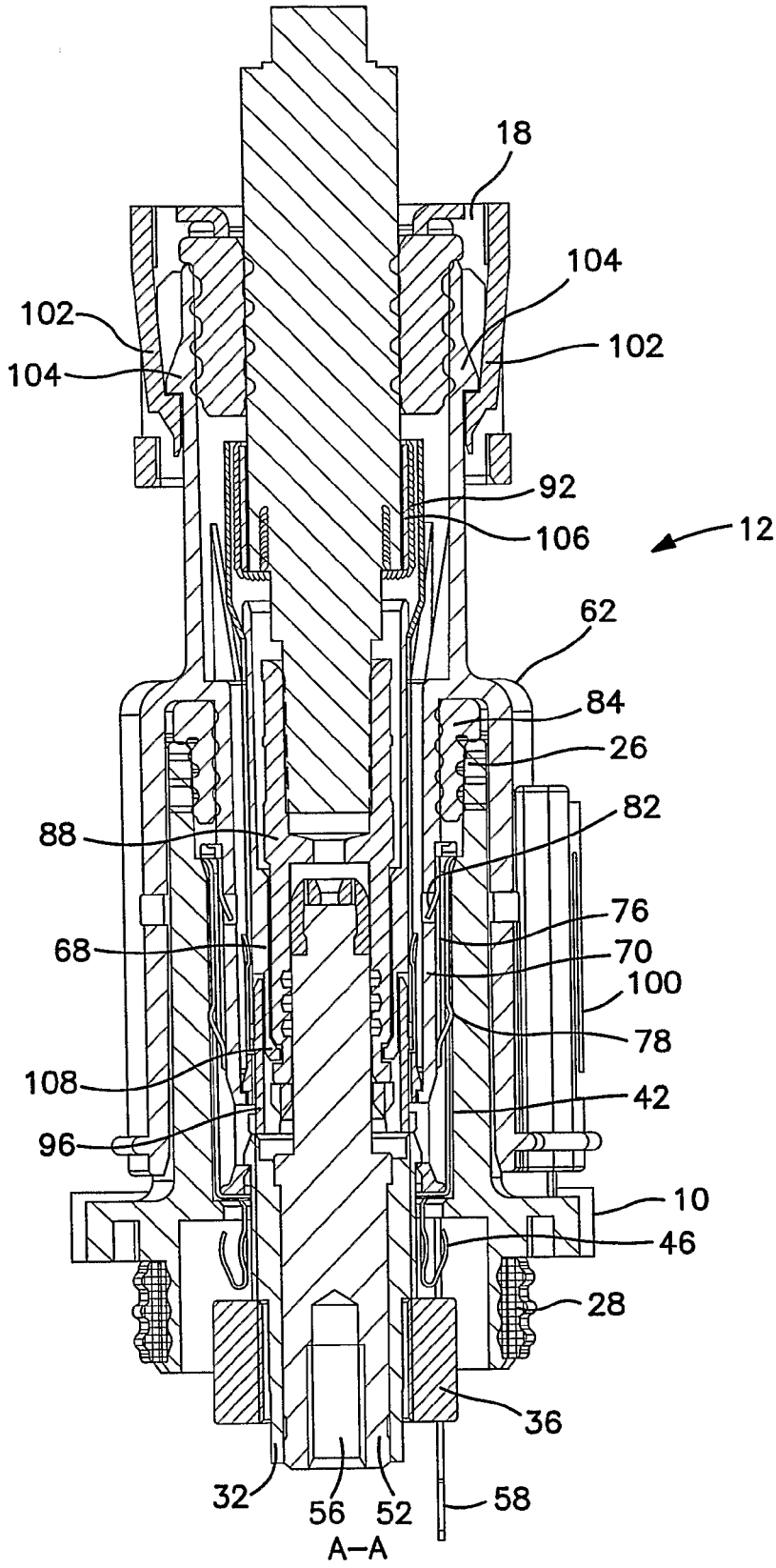
FIG. 6 is an orthogonal cross-sectional view taken at cutting line A-A of FIG. 1 of the plug of FIG. 1.

FIG. 6 shows that the cap 18 is held in place by a catch connection between two mutually opposing cover locking elements 102 and corresponding catch elements 104 on the housing 62. In addition, FIG. 6 shows the outer conductor 92 turned down and squashed between the internal crimping sleeve 106 and the shield element 90.

It can additionally be seen how the spring members 82 of the shield 76 engage in corresponding openings in the support sleeve 70, in order to hold the shield 76 on the support sleeve 70. The first spring contacts 78 produce an electrically conductive connection between the shield 76 of the plug 12 and the shield element 42 of the plug receptacle 10. The locking members 108 engage in the groove 94 in the inner conductor element 88. The securing element 96 locks this catch connection by filling a cavity between the locking member 108 and the outer conductor element 90, so preventing deflection of the locking member 108, which could result in release of the connection.

Figure 7:
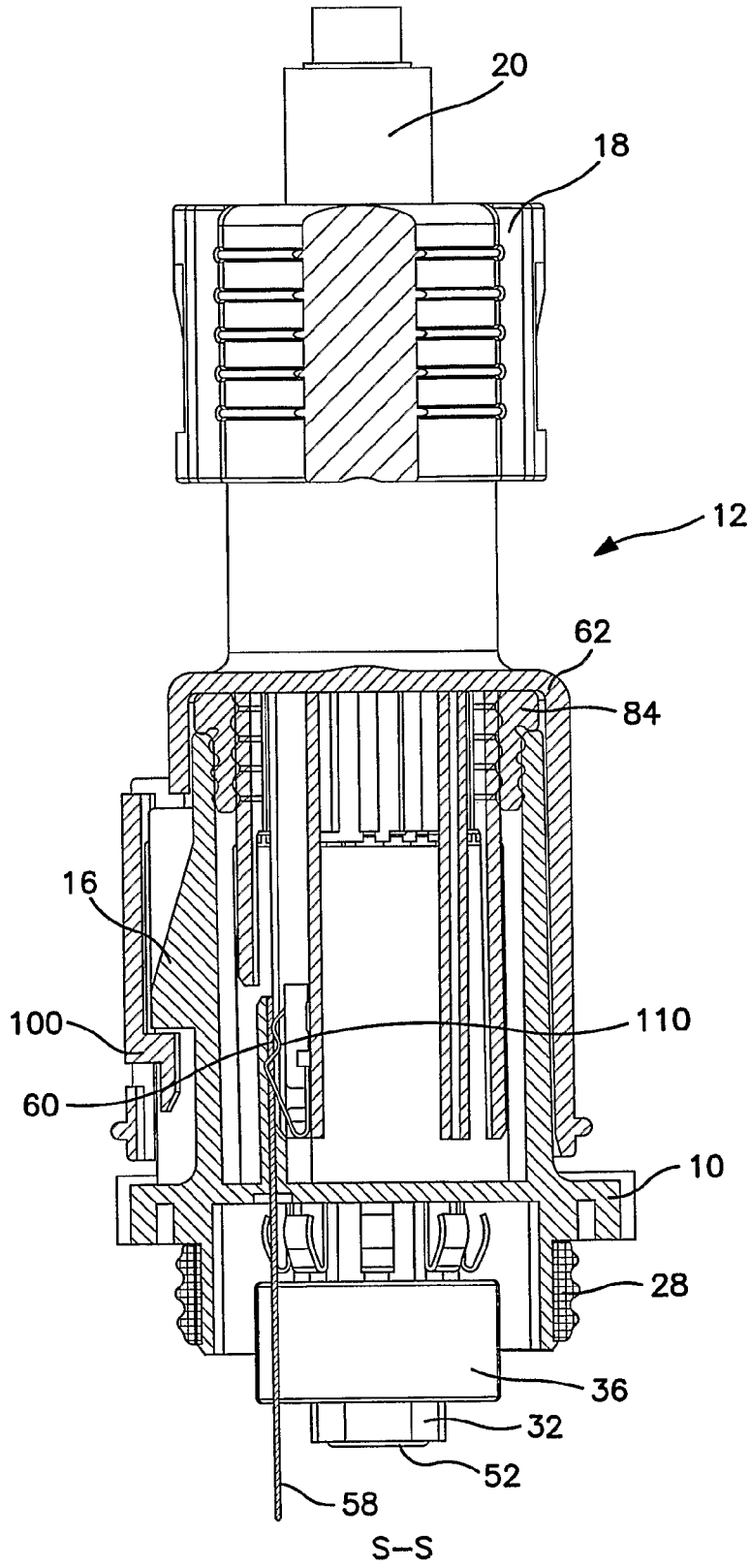
FIG. 7 is an orthogonal cross-sectional view taken at cutting line S-S of FIG. 1 of the plug of FIG. 1.

FIG. 7 shows the catch connection between the latch member 16 of the plug receptacle 10 and the latching spring 100 of the plug 12. A resilient short-circuit contact 110 mounted in the plug 12 is also visible, which short-circuit contact 110 short-circuits the upper ends 60 of the signal contacts 58 when the plug 12, as shown, is connected with the plug receptacle 10.

Figure 8:
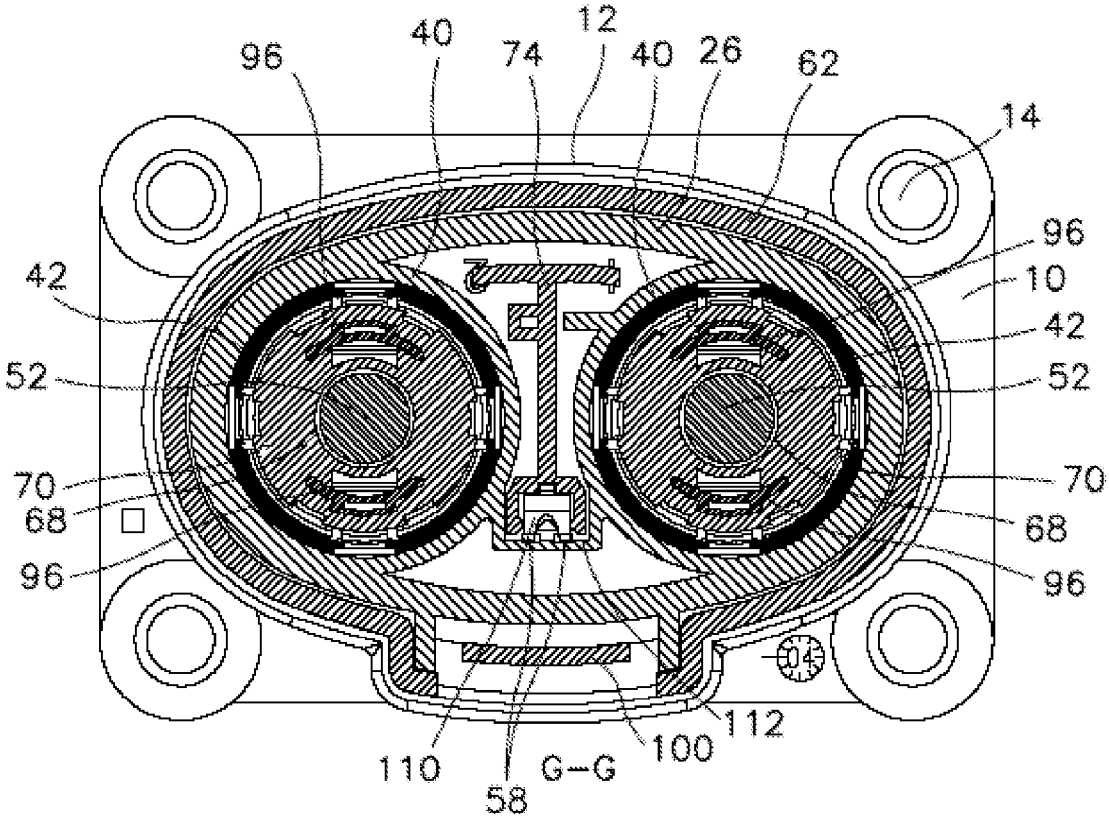
FIG. 8 is an orthogonal cross-sectional view taken at cutting line G-G of FIG. 5 of the plug of FIG. 1.

Referring now to FIG. 8, the housing 62 of the plug 12 is drawn over the first collar 26. A section through the lower end of the latching spring 100 of the plug 12 is visible. FIG. 8 also shows how the shield elements 42 of the plug receptacle 10 are arranged in the guide members 40 in the plug receptacle 10. The signal contacts 58 are arranged on a wall 112 connecting the guide members 40 together. An open channel is formed in a vertical edge of the web 74 opposite the wall 112. The short-circuit contact 110 is mounted in the channel. Merged lower ends of the insulator sleeves 68 and the support sleeves 70 are also shown. Furthermore, the securing elements 96 are each shown in two sections.

Figure 9:
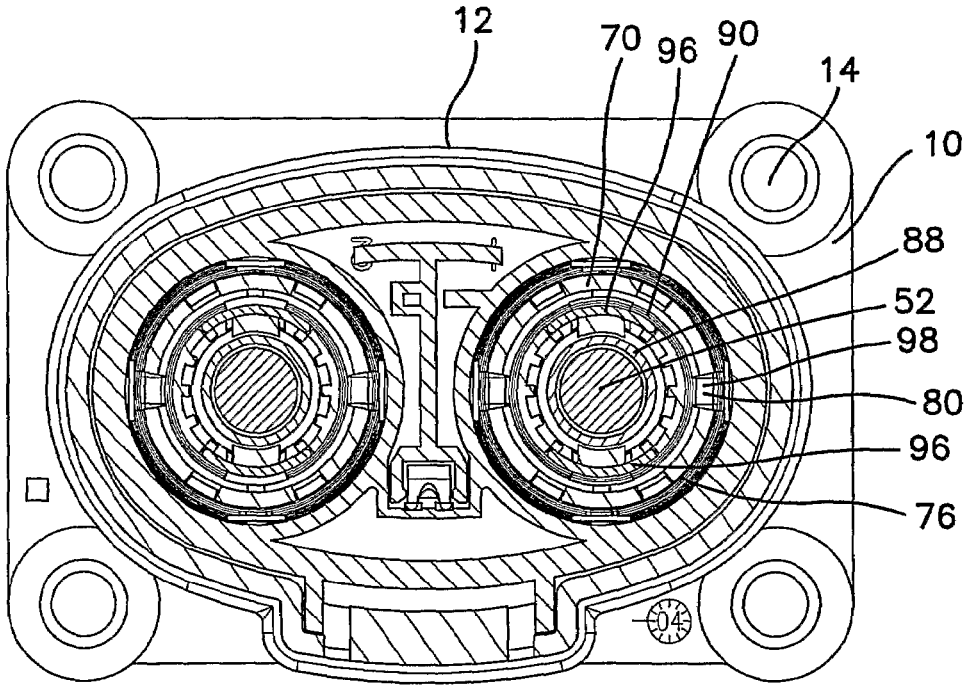
FIG. 9 is an orthogonal cross-sectional view taken at cutting line H-H of FIG. 5 of the plug of FIG. 1.

Referring now to FIG. 9, the openings 98 in the support sleeve 70 through which the second spring contacts 80 of the shield 76 contact the outer conductor element 90 are shown.

Figure 10:
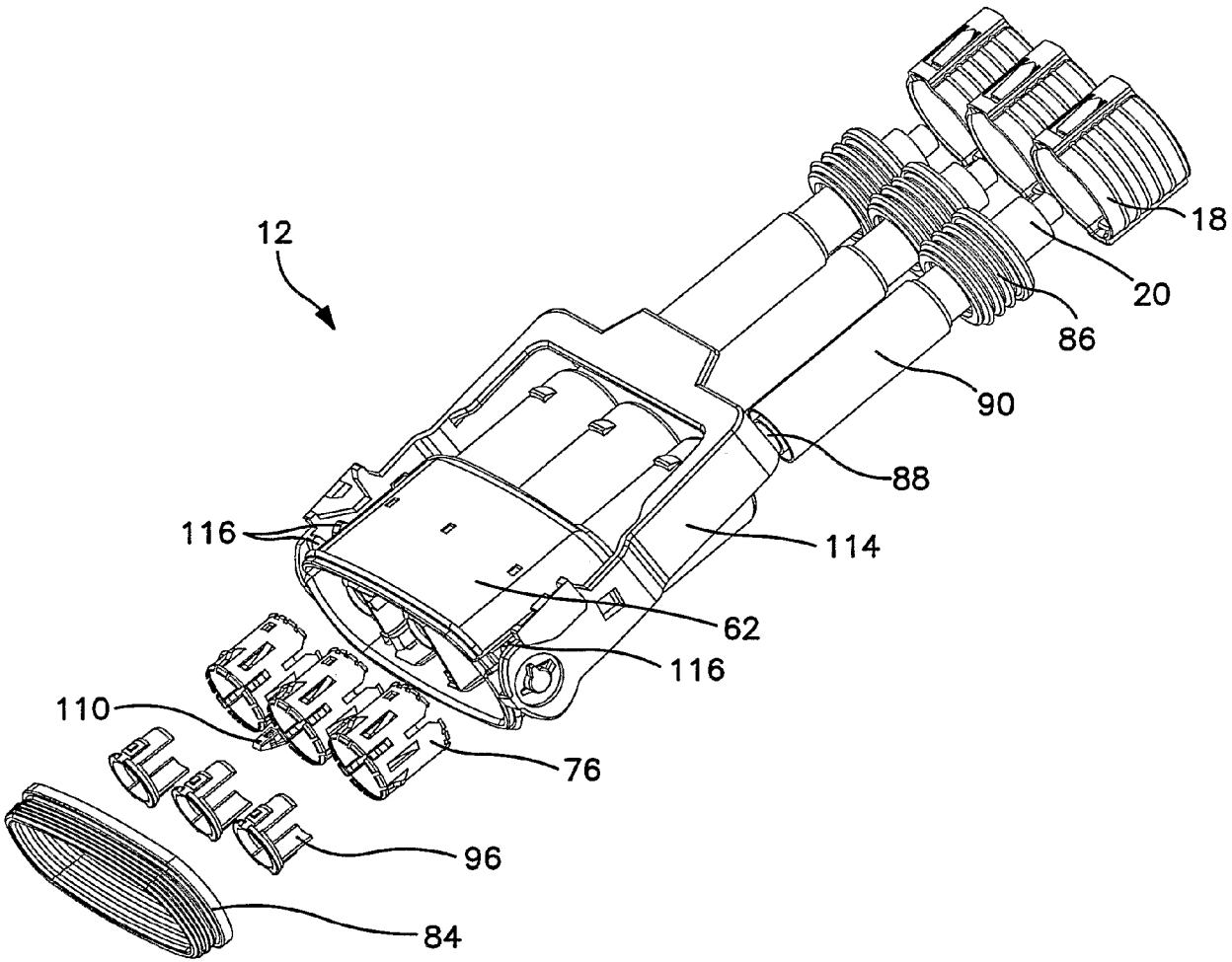
FIG. 10 is an oblique exploded view of a plug according to an alternate embodiment of the present invention.

Referring now to FIG. 10, an alternate embodiment is shown which differs in that the plug is designed for the connection of three of the cables 20. In addition, instead of a latching connection between the plug receptacle 10 and the plug 12, an insertion aid 114 is provided in the form of a substantially rectangular U-shaped stirrup element. The ends of this stirrup element are connected with the housing 62 of the plug 12 so as to swivel about a common axis.

When connecting the plug 12 to a corresponding plug receptacle, the insertion aid 114 is first turned relative to the illustrated position by an angle of around 90°. Once the plug 12 has been fitted to the plug receptacle 10, the insertion aid 114 is swivelled into the position illustrated, wherein lugs 116 on the insertion aid 114 engage in corresponding features on the plug receptacle 10 in the manner of a rack and pinion. The swivel movement of the insertion aid 114 is draws the plug 12 towards the plug receptacle. When the insertion aid 114 is in the illustrated position, the plug 12 is completely connected with the plug receptacle 10 in the intended manner.

Figure 11:
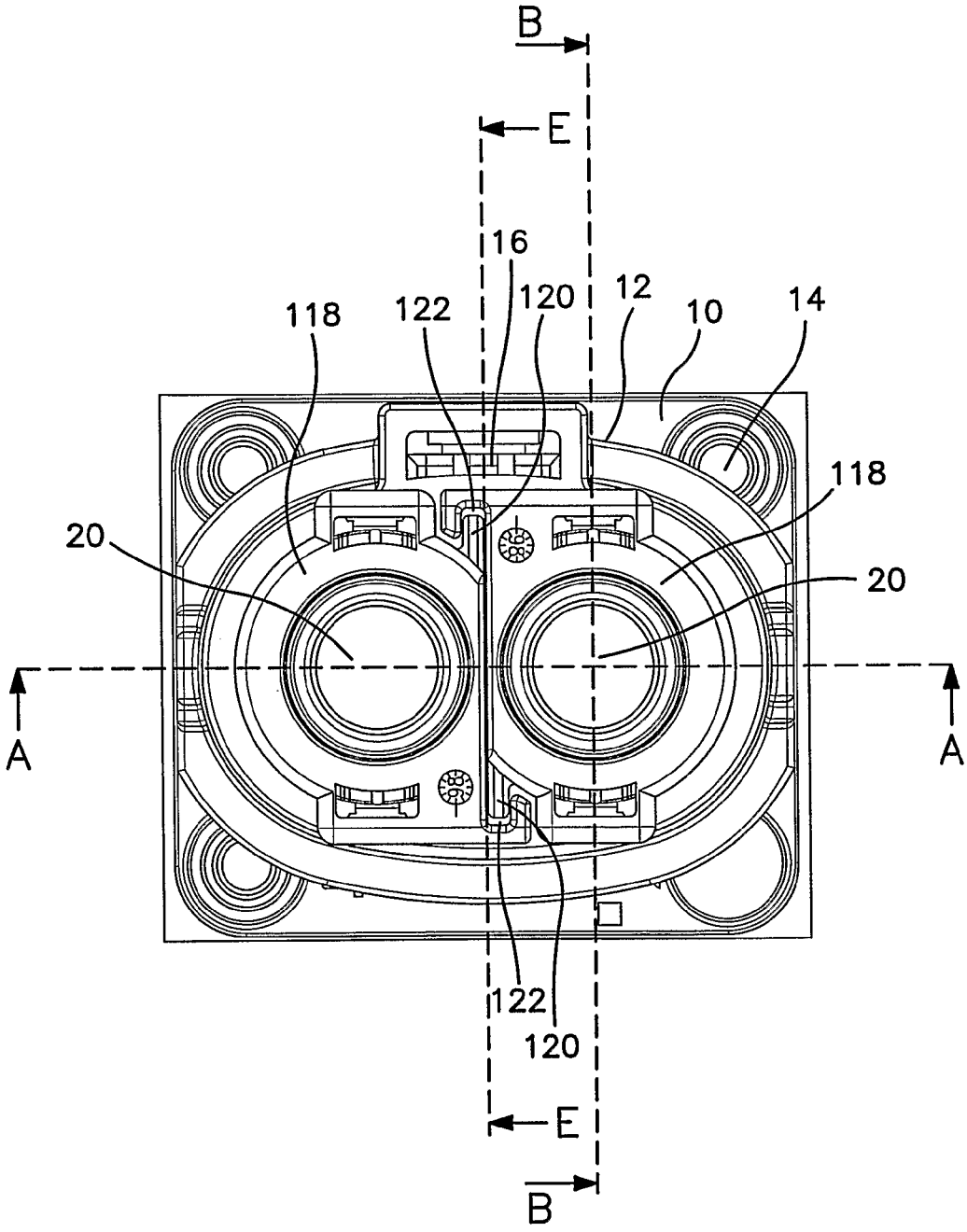
FIG. 11 shows an orthogonal view of a plug according to a another alternate embodiment of the present invention.

FIG. 11 illustrates that an alternate embodiment of the plug receptacle 10 comprises a substantially rectangular plate, at each of the corners of which there is provided the through-holes 14 for attaching the plug receptacle 10 to the electrical apparatus, for example. The perspective of the drawing is parallel to the cables 20, which are shown here in cross-section. The cables 20 are surrounded by a cable cover formed of two identical, symmetrically arranged cover members 118. Each of the cover members 118 comprises a cover web 120 and a cover groove 122. The cover web 120 of one of the cover members 118 engages in each case in the cover grooves 122 of the other cover member 118 in such a way that the two cover members 118 are held together and support one another. The latch member 16 on the plug receptacle 10 serves to attach the plug 12 to the plug receptacle 10.

Figure 12:
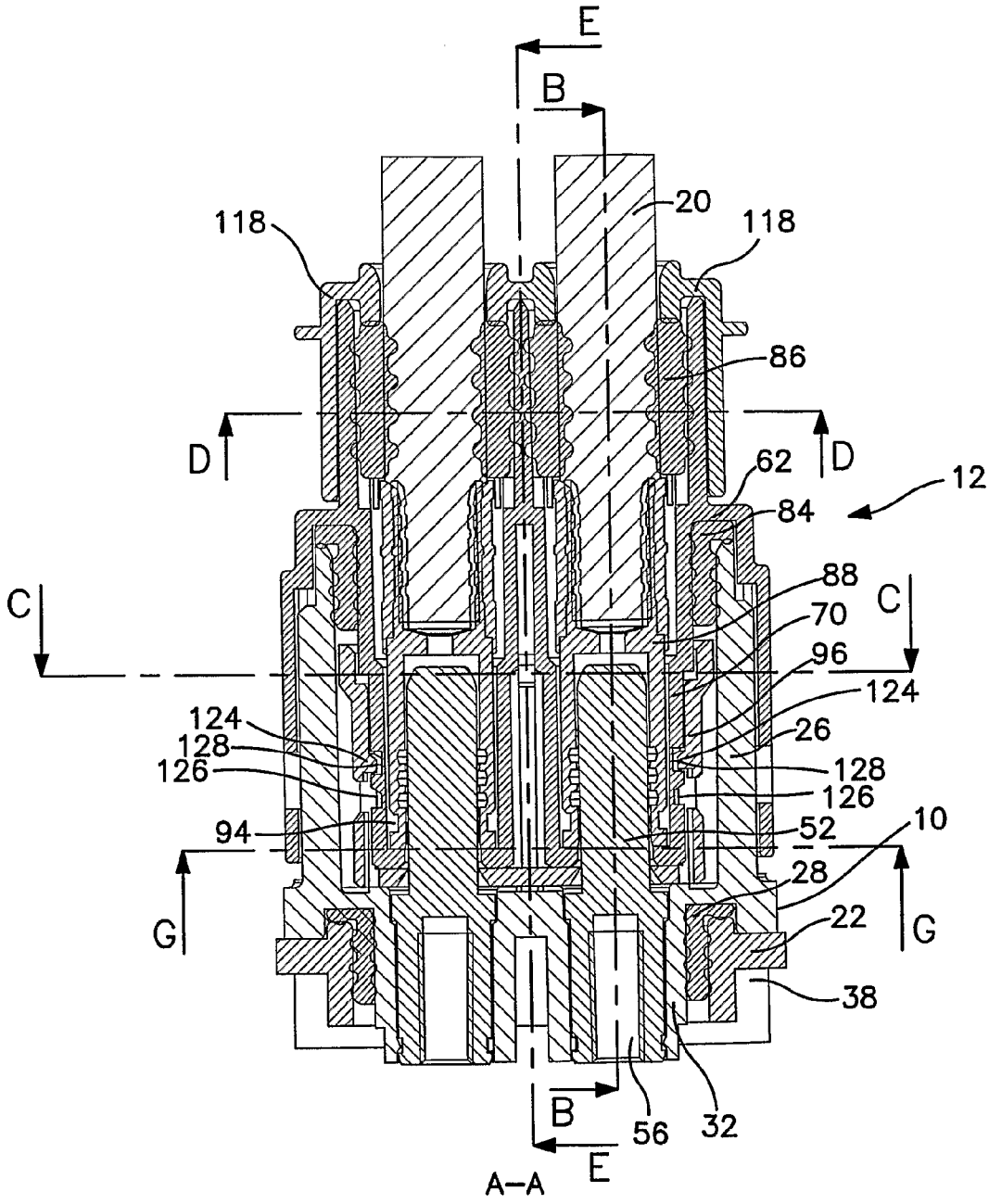
FIG. 12 is an orthogonal cross-sectional view taken at cutting line A-A of FIG. 11 of the plug of FIG. 11.

FIG. 12 shows that the plug receptacle 10 comprises the first collar 26 at its top facing the plug 12 and the two sleeves 32 at its bottom. Between the plug receptacle 10 and the plate 22, which may be a separate component or part of the housing 62 of the electrical apparatus, there is provided the seal 28.

Two of the contact pins 52 are arranged parallel to the plug receptacle 10. The upper ends of the contact pins 52 are arranged inside the first collar 26. The lower ends of the contact pins 52 are arranged in the sleeves 32, which they may fill completely and in which they are held by a latch connection or otherwise. The contact pins 52 further comprise the bores 56 at their lower ends, by means of which the electrical lines may be connected to the contact pins 52, for example by screw fittings.

The plug 12 comprises the housing 62, which, in the plug-in area 64 is arranged at the front with respect to the plug-in direction, in which area a plug-and-socket connection may be produced with the plug receptacle 10. The housing 62 exhibits the approximately oval cross-section also visible in FIG. 11. In the cable area 66 at the opposite end at the rear with respect to the plug-in direction of the plug connector 12, the cross-section of the housing 62 exhibits approximately the form of an 8 or two circles touching one another. In other words, in the cable area 66 the housing 62 exhibits approximately the form of two merging parallel tubes in each case of circular cross-section.

In the cable area 66, the cable cover consisting of the cover members 118 is drawn over the housing 62. Each of the cover members 118 is drawn in the manner of a cover over one of the two tubular portions of the housing 62. The cover members 118 in each case hold the cable seal 86 in a toroidal cavity between the respective cable 20 and the housing 62. To allow a small distance between the cables 20 and thus also small overall dimensions of the plug 12, each of the cover members 118 comprises an opening 138 (see FIG. 14) on its side facing the respective other cover member 118. This makes possible the above-described cross-section of the housing 62 consisting of the two merging circles.

The plug seal 84 is arranged inside the housing 62 between the latter and the cable 20 of the plug receptacle 10. The inner conductor element 88 is connected electrically conductively and mechanically with the inner conductor of each of the cables 20 by crimping or otherwise. At the front end with respect to the plug-in direction or the end facing the plug receptacle 10, each of the inner conductor elements 88 has an opening towards the plug receptacle 10, which opening is designed to receive the contact pin 52 of the plug receptacle 10. In addition, each of the inner conductor elements 88 comprises the groove 94 at the front end around its external outer circumference.

In the plug-in area 64 of the plug 12, the inner conductor elements 88 are arranged in each case in the support sleeve 70. The securing element 96 is drawn over the two support sleeves 70. Projections 124 on the securing element 96 engage in corresponding first and second recesses 126, 128 in the support sleeves 70. Each of the projections 124 is associated with two recesses in the support sleeve 70. When the projections 124 engage in the first recesses 126, the securing element 96 finds itself in a preliminary locking position. When the projections 124 of the securing element 96 engage in the second recesses 128, the securing element 96 is located in a locking position described further below.

Figure 13:
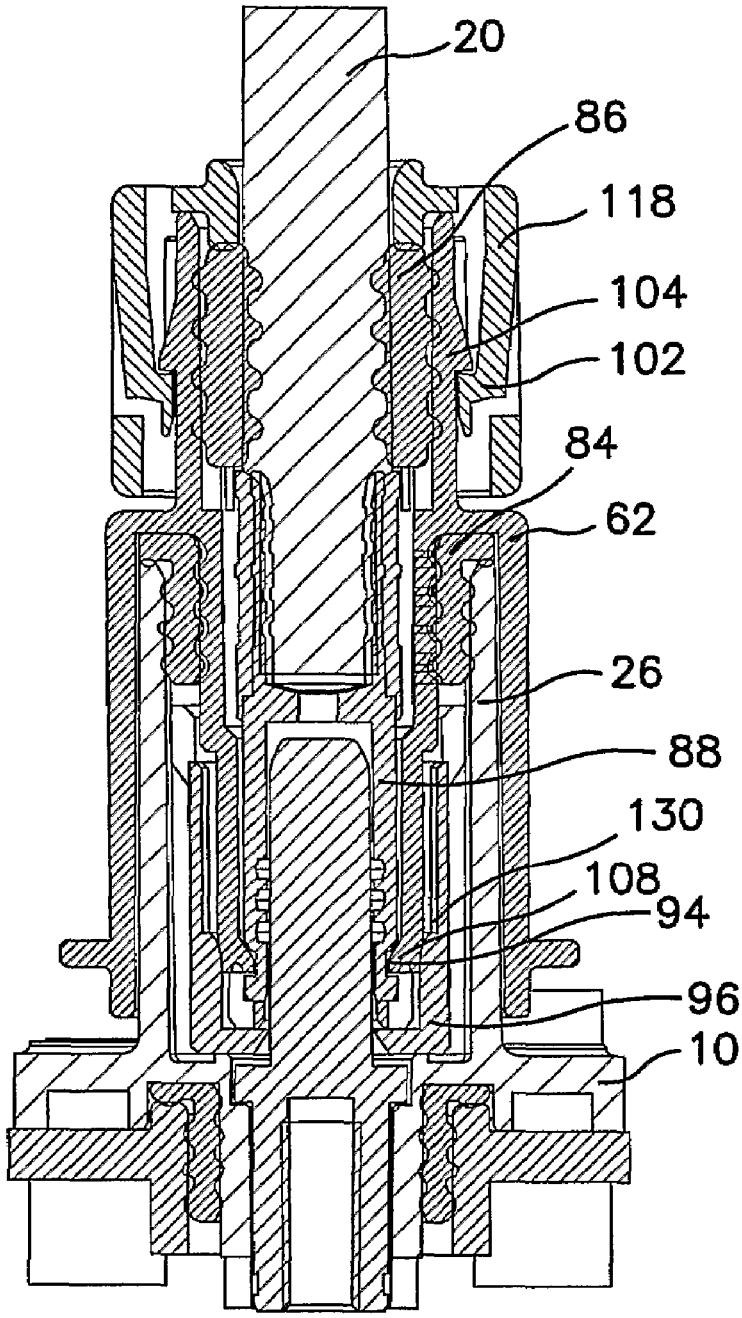
FIG. 13 is an orthogonal cross-sectional view taken at cutting line B-B of FIG. 11 of the plug of FIG. 11.

FIG. 13 shows that each of the cover members 118 is attached on two opposing sides in each case by a cover locking element 102 and a corresponding cover locking member 104 on the housing 62 of the plug 12. It can additionally be seen how the locking member 108 formed on the support sleeve 70 engages in the groove 94 in the conductor element 88, to hold the latter in the housing 62.

In the locking position shown, the securing element 96 rests on the outside of the locking member 108 and so prevents the locking member 108 from becoming unlocked by outward deflection out of the groove 94. When the securing element 96 is in the preliminary locking position, the locking member 108 may be deflected outwards into a recess 130 in the securing element 96. Therefore, in the preliminary locking position of the securing element 96, a connection between the inner conductor element 88 and the locking members 108 and likewise the release thereof is possible.

Figure 14:
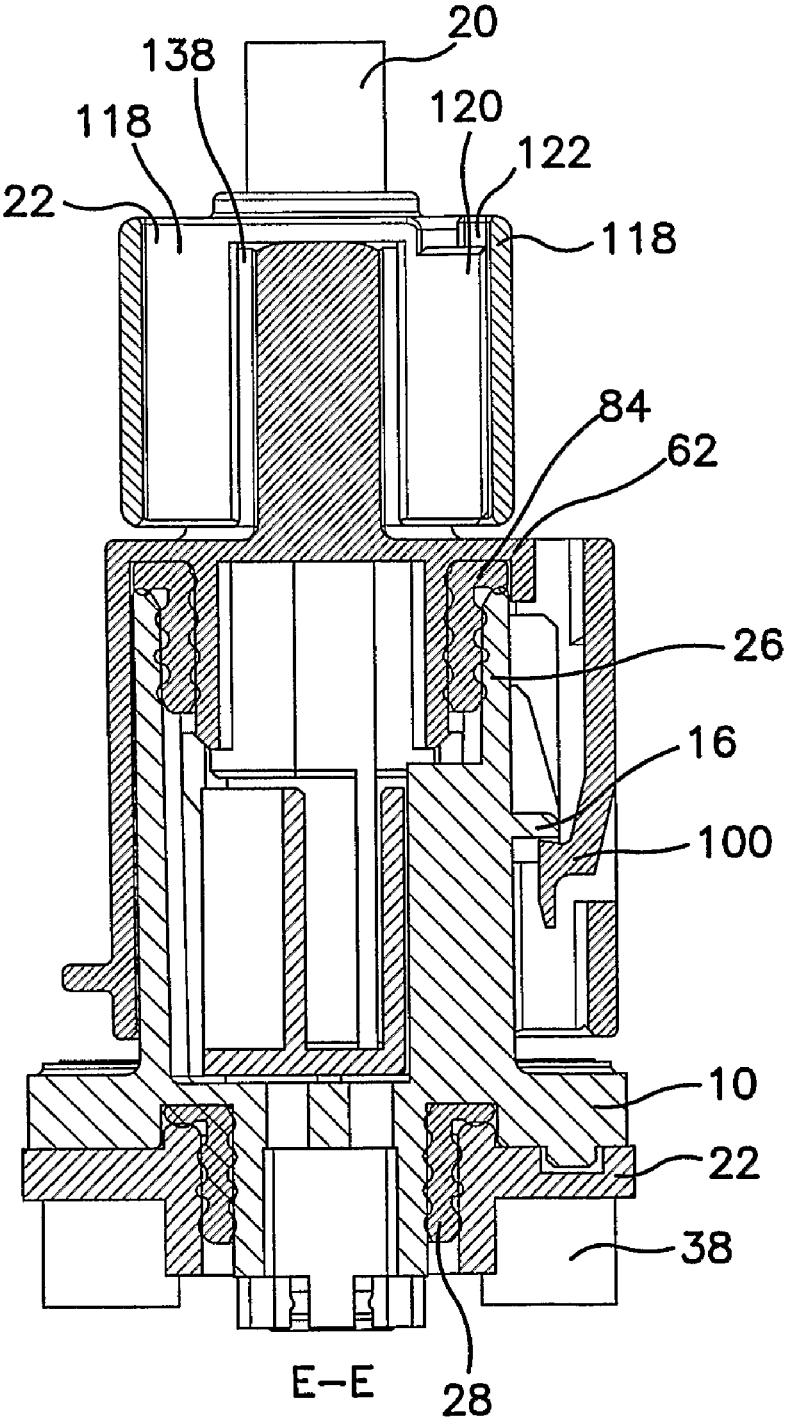
FIG. 14 is an orthogonal cross-sectional view taken at cutting line E-E of FIG. 11 of the plug of FIG. 11.

FIG. 14 shows the connection between the latch members 16 of the plug receptacle 10 and a latching spring 100 on the housing 62 of the plug connector 12, by means of which the plug 12 is held on the plug receptacle 10. In addition, the lateral opening 138 already mentioned above in the cover member 118 is visible on the side thereof facing the other cap member.

Figure 15:
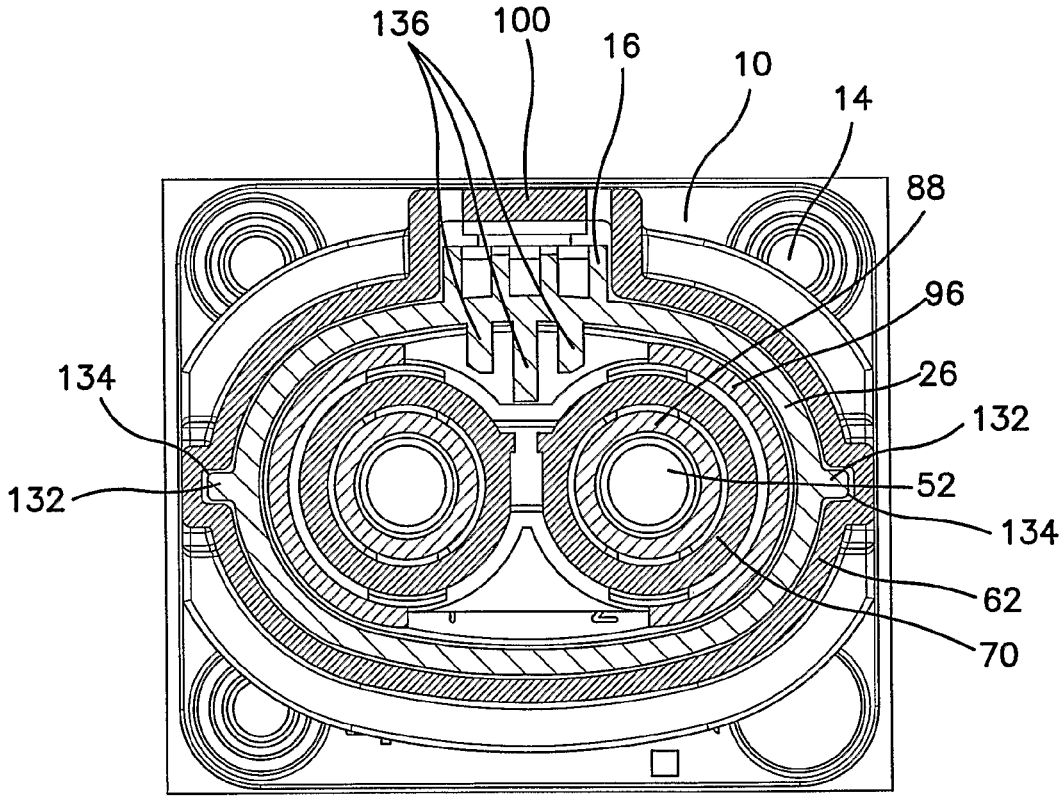
FIG. 15 is an orthogonal cross-sectional view taken at cutting line C-C of FIG. 12 of the plug of FIG. 11.

FIG. 15 shows two external webs 132 on the first collar 26 of the plug receptacle 10, the external webs 132 are arranged parallel to the plug-in direction and engage in corresponding collar grooves 134 in the housing 62 of the plug 12. This effectively prevents twisting of the plug 12 relative to the plug receptacle 10, which would otherwise be possible because of the oval cross-section and the inevitable elasticity of the housing 62 and of the first collar 26 and which could impair functioning of the plug seal 84 (FIGS. 12 to 14) between the plug receptacle 10 and the plug 12.

It is also clear that space remains in the area between the support sleeves 70 to provide latitude for development of the cross-sections of the plug receptacle 10 and of the plug 12. In the present exemplary embodiment, internal webs 136 are arranged on an inside of the first collar 26 of the plug receptacle 10 parallel to the plug-in direction. The plug 12 exhibits a corresponding shape, such that it may be introduced into the plug receptacle 10. If the internal webs 136 or corresponding features on the plug receptacle 10 are arranged or sized differently and given different geometrical shapes and the plug 12 is shaped accordingly, a coding function may be achieved, such that only one of a plurality of different ones of the plugs 12 in each case matches a plug receptacle 10 selected from a plurality of different ones of the plug receptacles 10.

An advantage of the present invention is that, on the plug 12 side, this coding function may be achieved solely by shaping the securing element 96 appropriately. If it is to be ensured, therefore, that a given one of the plugs 12 should match only a given one of the plug receptacles 10, the housing 62 does not have to be conformed thereto, but only the securing element 96. This means in practice that the housing 62 is produced in large numbers and thus economically and is used for more than one of the plugs 12 at different sites and for different purposes. Furthermore, the substantially less complex securing element 96 is produced in different shapes in each case in smaller numbers. Then, on fitting the plug 12, depending on whether the plug 12 is provided for example for a cable between an energy source and a power converter or for a cable between a power converter and a drive motor, a corresponding one of the securing elements 96 is selected from the plurality of different securing elements which exclusively matches the plug receptacle 10 to be connected with the plug 12.

Figure 16:
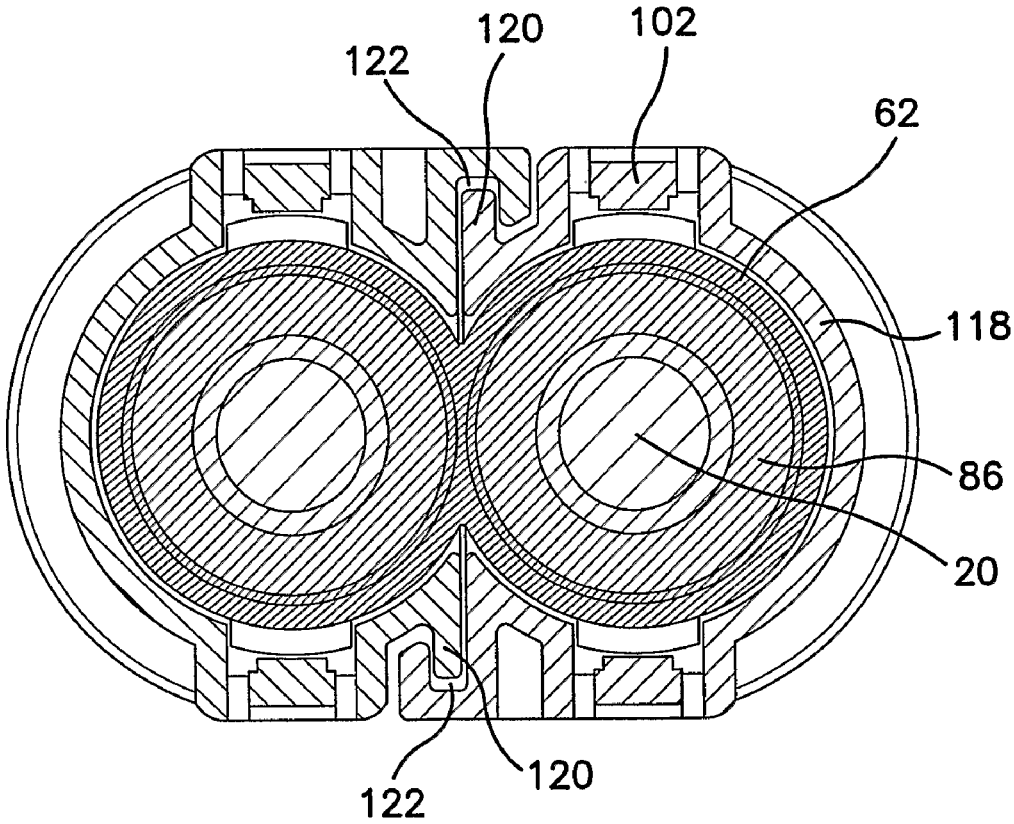
FIG. 16 is an orthogonal cross-sectional view taken at cutting line D-D of FIG. 12 of the plug of FIG. 11.

FIG. 16 shows the cover locking element 102 by which the cover members 118 are held on the housing 62 of the plug 12. As described above, the housing 62 exhibits a cross-section in the cable area 66 shown which consists substantially of two touching and slightly overlapping circular rings. The cable 20 and the cable seal 86 are arranged inside the housing 62.

Figure 17:
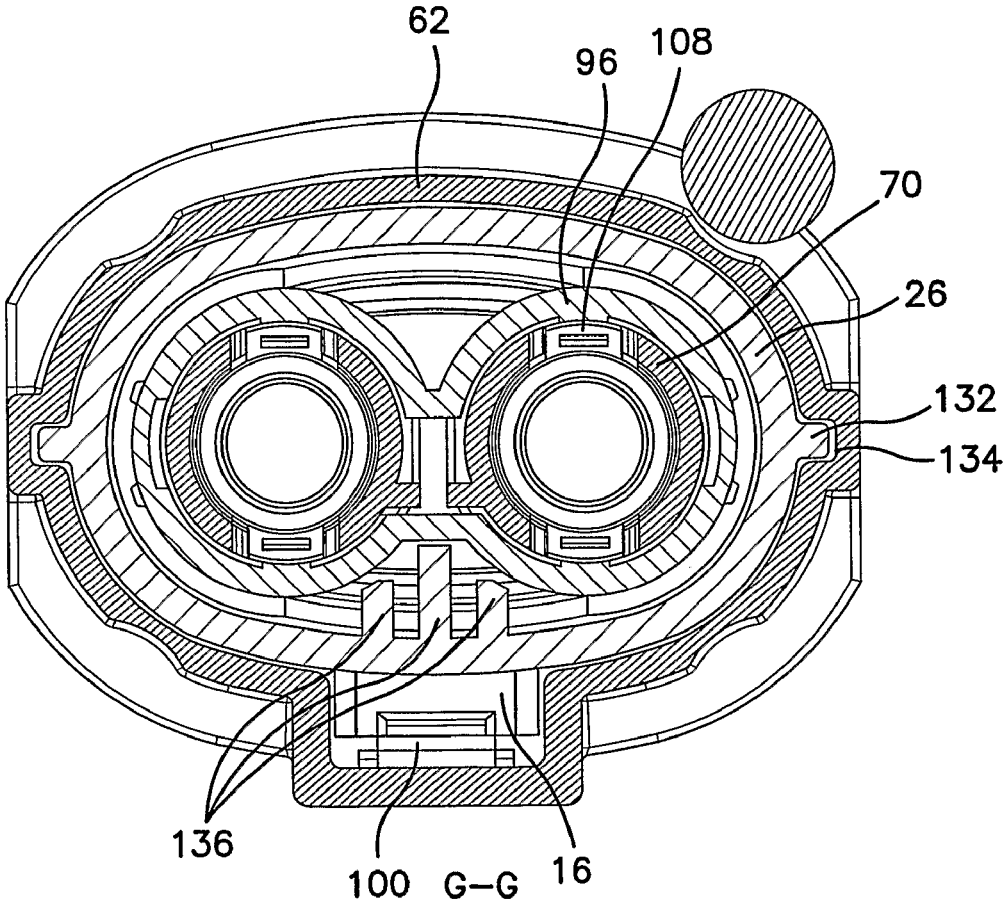
FIG. 17 is an orthogonal cross-sectional view taken at cutting line G-G of FIG. 12 of the plug of FIG. 11.

FIG. 17 again shows the coding function of the securing element 96 in interaction with the configuration of the first collar 26 provided with the internal webs 136. In addition, FIG. 17 shows the locking members 108 on the sleeves 70 and how they are locked by the securing element 96.

The two exemplary embodiments of the present invention described above in relation to FIGS. 1-10 and 11-17 differ in several ways. The first exemplary embodiment is designed for cables with shields, wherein the shield potential is transmitted by the plug 12 and the plug receptacle 10. Separate cable covers are provided for the cables 20, which cable covers hold the cable seals 86 in place. In addition, the first exemplary embodiment comprises the signal contacts 58 for the above-described interlock function. The second exemplary embodiment is provided for cables without shields. The cable seals 86 are held in place by the cable cover consisting of two symmetrical cover members 118 and are held together by a retaining means and provide one another with support. In addition, the second exemplary embodiment provides a coding function, which is provided on the plug 12 side by the securing element 96. In addition, the second exemplary embodiment provides the external webs 132 and the collar grooves 134, which prevent twisting of the plug 12 relative to the plug receptacle 10. It is quite obvious that each of these features may advantageously and readily be combined with the respective other exemplary embodiment.

As has already been explained in relation to the variant of the first exemplary embodiment described in FIG. 10, the present invention may be readily applied to plugs 12 and plug receptacles 10 with more than two cables. This is also true of the second exemplary embodiment. In the second exemplary embodiment described, the two cover members 118 exhibit the same shape and are arranged, relative to the drawing planes of FIGS. 11 and 16, point-symmetrically around a point between the cover members 118. In the case of the plug 12 for more than two cables, or indeed in the case of the plug 12 with precisely two cables, the cable cover are identical to one another and arranged symmetrically relative to a translational movement perpendicular to the plug-in direction by the spacing of the two cables. This means, for example, that each of the cover members 118 comprises the cover web 120 and the cover groove 122 on each side, so as to be connectable on each side with the other one of the cover members 118.

In both the exemplary embodiments illustrated, the housing 62, the support sleeve 70 and the insulator sleeve 68 may be of integral construction. A particular advantage of the first exemplary embodiment consists in the fact that the housing 62 may be made from an electrically insulating material, in particular a plastic material, and also that no conductive coating, for example in the form of metallization, is necessary since the shield potential is transmitted to the plug receptacle 10 by the shield element 90 and the shield 76. It is particularly economical for the housing 62 to be made from a plastic material and without any conductive coating.

Most of the features of the present invention are furthermore readily applicable to a plug receptacle 10 and a plug 12 designed for only a single-conductor shielded or unshielded cable.

Figure 18:
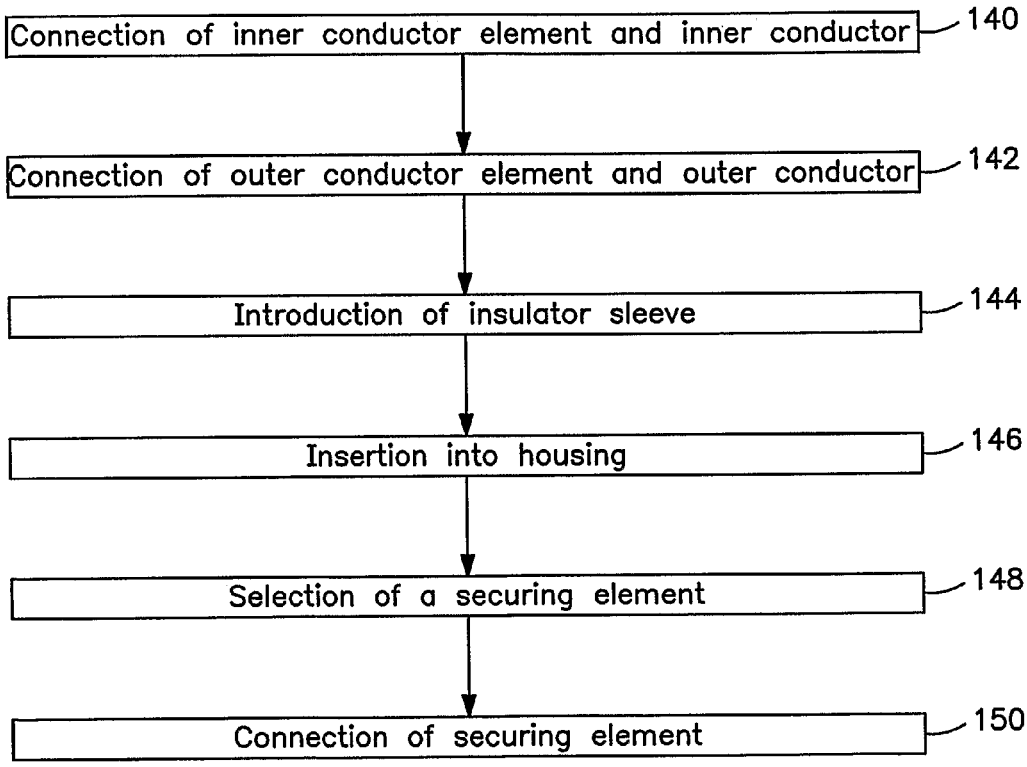
FIG. 18 is a schematic flowchart of a method of fitting a plug to a cable according to another embodiment of the present invention.

FIG. 18 is a schematic representation of a flowchart of a method of fitting the plug 12 to the cable 20 according to a further exemplary embodiment of the present invention.

In a first step 140, inner conductor elements 88 are connected with the inner conductors of all the cables 20 provided for fitting to the plug 12. This may be performed by crimping. In a second step 142, the outer conductor element 90 is connected with the exposed outer conductor 92 of each of the cables 20. This also may be performed by crimping. In a third step 144, the insulator sleeve 68 is introduced between the inner conductor element 88 and the outer conductor element 90. In a fourth step 146, the cable 20 is inserted with the inner conductor element 88 and the outer conductor element 90 into the plug 12 or the housing 62. The third step 144 and the fourth step 146 may take place simultaneously. Alternatively, the third step 144 takes place before or after the fourth step 146.

In a fifth step 148, a securing element is selected from a plurality of different ones of the securing elements 96, in order to match the plug 12 to the plug receptacle 10 selected from a plurality of different ones of the plug receptacles 10. In a sixth step 150, the securing element 96 is connected to the plug 12, wherein at the same time the inner conductor element 88 is locked in the plug 12.

The second step 142 of connecting the outer conductor element 90 with the exposed outer conductor 92 may comprise the steps described below. First of all, the diameter of the shield of the cable 20 is determined. Depending on this diameter, an internal crimping sleeve 106 (see FIG. 6) with a suitable diameter or an external crimping sleeve with a suitable diameter is then selected. The selected internal or external crimping sleeve is then used to crimp the outer conductor element 90 together with the exposed outer conductor 92 of the cable 20. This procedure has the advantage that the same outer conductor element 90 may be used for cables 20 with different diameters.

The invention claimed is:

1. An electrical plug for connecting a cable to a plug receptacle, the electrical plug comprising:

a housing which substantially surrounds a plug-in area and a cable area;

an insulator sleeve constructed of an electrically insulating material which substantially surrounds a channel extending from the plug-in area to the cable area for receiving an inner conductor element;

a support sleeve which substantially surrounds the insulator sleeve connected mechanically with the insulator sleeve in the plug-in area and is connected mechanically with the housing in the cable area;

a first cavity located substantially between the insulator sleeve and the support sleeve and configured to receive an outer conductor element; and a second cavity which substantially surrounds the support sleeve in the plug-in area and configured to receive a shield element of the plug receptacle a latching spring for connecting with a latch member of the plug receptacle; and a securing element locking together the inner conductor element and the housing of the plug.

2. The electrical plug according to claim 1, further comprising:

an opening in the support sleeve.

3. The electrical plug according to claim 1, further comprising:

a shield in the second cavity, the shield having a first spring contact configured to contact the shield element when the plug is connected with the plug receptacle.

4. The electrical plug according to claim 1, further comprising:

an opening in the support sleeve, which is so designed that a second spring contact connected with the outer conductor element, which is connected with the cable and is inserted into the first cavity, contacts the shield element of the plug receptacle through the opening when the plug is connected with the plug receptacle.

5. The electrical plug according to claim 1, wherein the housing, the insulator sleeve, and the support sleeve are of integral construction.

6. The electrical plug according to claim 1, wherein the outer conductor element is substantially cylindrical tubular in shape.

7. The electrical plug according to claim 1, wherein a plurality of pairs of insulator sleeves and associated support sleeves are arranged substantially in parallel and wherein the pairs of insulator sleeves and associated support sleeves are associated with the housing.

8. The electrical plug according to claim 1, wherein the plug-in area has a substantially oval cross-section.

9. The electrical plug according to claim 1, further comprising:

an external web located in the plug-in area substantially parallel to a plug-in direction.

10. The electrical plug according to claim 1, wherein the inner conductor element is connected with the cable by a crimp connection.

11. The electrical plug according to claim 1, wherein the outer conductor element is connected with the cable by a crimp connection.

12. An electrical plug for connecting a plurality of cables to a plug receptacle, the electrical plug comprising:

a housing which substantially surrounds a plug-in area and a cable area; and a plurality of shields, each shield configured to electrically connect an outer conductor of a cable and a shield element of the plug receptacle when the plug is connected with the plug receptacle a latching spring for connecting with a latch member of the plug receptacle; and a securing element locking together the inner conductor element and the housing of the plug.

13. The electrical plug according to claim 12, wherein the housing is constructed of an electrically insulating material.

14. An electrical plug for connecting a first cable and a second cable to a plug receptacle, the electrical plug comprising:

a housing which substantially surrounds a plug-in area and a cable area;

a cable seal between the housing and the first and second cables; and a cap configured to hold the cable seal in place on the housing;

wherein the cap comprises two cover members which each grip around one of the first and second cables a latching spring for connecting with a latch member of the plug receptacle; and a securing element locking together the inner conductor element and the housing of the plug.

15. The electrical plug according to claim 14, further comprising:

a retaining means which holds the two cover members together.

16. The electrical plug according to claim 15, wherein the retaining means comprises a cover web on one of the cover members and a cover groove in the other cover member and wherein the cover web and the cover groove engage with one another.

17. The electrical plug according to claim 14, wherein the two cover members are identical in shape and are arranged symmetrically with one another on the plug.

18. The electrical plug according to claim 14, wherein each of the cover members is cup shaped.

19. The electrical plug according to claim 18, wherein each cover member comprises a lateral opening on the side facing the other cover member.

20. A method of fitting a plug connector to a cable, comprising the steps of:

connecting an inner conductor element with an inner conductor of the cable;

connecting an outer conductor element with an outer conductor of the cable;

introducing an insulator sleeve between the inner conductor element and the outer conductor element; and inserting the inner conductor element and the outer conductor element into a housing of the plug a latching spring for connecting with a latch member of the plug receptacle; and a securing element locking together the inner conductor element and the housing of the plug.

21. The method according to claim 20, wherein the steps of introducing the insulator sleeve and inserting the inner and outer conductor elements into the housing are performed simultaneously.

22. The method according to claim 21, further comprising the step of:

before latching the securing element, selecting a securing element from a plurality of securing elements in order to match the plug to a plug receptacle selected from a plurality of different plug receptacles.

23. The method according to claim 20, wherein the step of connecting the outer conductor element with the outer conductor comprises:

determining the diameter of the outer conductor of the cable;

selecting an internal crimping sleeve or an external crimping sleeve depending on the diameter of the outer conductor; and crimping together of the outer conductor elements with the outer conductor and the selected internal crimping sleeve or external crimping sleeve.

* * * * *